United States Patent [19]

Oh

[11] Patent Number: 4,736,180

[45] Date of Patent: Apr. 5, 1988

[54] FUSE WIRE ASSEMBLY FOR ELECTRICAL FUSE

[75] Inventor: Seibang Oh, Elk Grove Village, Ill.

[73] Assignee: Littelfuse, Inc., Des Plaines, Ill.

[21] Appl. No.: 69,368

[22] Filed: Jul. 1, 1987

[51] Int. Cl.[4] ..... H01H 85/04

[52] U.S. Cl. ..... 337/163; 337/164; 337/229; 337/273; 337/278

[58] Field of Search ..... 337/163, 164, 165, 166, 337/274, 227, 228, 229, 231, 278, 273, 276, 280

[56] References Cited

U.S. PATENT DOCUMENTS 4,445,106 4/1984 Shah ..... 337/163

4,560,971 12/1985 Oh ..... 337/164

*Primary Examiner*—Harold Broome

*Attorney, Agent, or Firm*—Russell E. Hattis; Lawrence J. Bassuk

[57] ABSTRACT

A core assembly having a flexible insulating material core and a spirally wound inner fuse wire engages with one or more elongate bodies of the flexible insulating material to sandwich and compress the inner fuse wire therebetween. An arc burning between the blown ends of the inner fuse wire will be blocked and quenched by the core and body insulating materials expanding or moving into the space where the arc subsists and is burning away a portion of the inner fuse wire. An outer fuse wire, an outer wrapper of shrinkable tubing or twisting together the core assembly and the elongated body or bodies retains the core assembly and insulating body or bodies engaged along their length and forms a fuse wire assembly.

30 Claims, 3 Drawing Sheets

FUSE WIRE ASSEMBLY FOR ELECTRICAL FUSE

BACKGROUND OF THE INVENTION

This invention relates generally to electrical fuses having a fuse wire spirally wound upon an insulating support core and that is connected between and suspended from the end cap terminals of a cylindrical insulating housing. Particularly, the invention relates to providing improved arc quenching and time delay for such fuses, although the invention is not limited to providing improved time delay and can be applied with advantage to fast acting fuses.

Spiral wound fuses are well known. U.S. Pat. No. 4,445,106 to Shah, assigned to the assignee of this application, discloses an advantageous core material used for such fuses, namely a core made from a ceramic fiber material sold by the 3M Company of St. Paul, Minn. under the mark NEXTEL. This material is specially treated to remove all sizing or binding material that could become conductive under fuse blowing conditions.

In higher current rated, such as 5–30 amperes, fuses, a high energy electrical arc can develop when the fuse wire blows. Such higher current rated fuses will generally use larger diameter fuse wire. The energy of such an arc is directly related to the diameter of the fuse wire so that larger diameter wire results in proportionately higher energy arcs. This electrical arc is sustained by continued overcurrent flow through the fuse and can burn the fuse wire away from the point of blowing to the end caps, at which time the fuse can explode with the attendant hazards to persons in the vicinity of the fuse.

Where the fuse wire is wound with a large or wide pitch (distance between the windings) and there is substantial space between the fuse wire turns along the core, the arc travels around the core. Where the pitch is narrow and the turns are closely spaced, the arc can jump from one turn to the next along the core. This arcing has been a problem because of the expense of applying conventional arc quenching materials, such as filler materials, to spiral wound fuses. As a result, lower cost spiral wound fuses have been limited in the current levels that they can safely protect. Inexpensive means for providing effective arc quenching would thus allow spiral wound fuses to protect against greater overload currents.

If improved arc quenching can be obtained, then the pitch of the spiral winding can be decreased to place more turns per inch on the core without arcing across the turns. This in turn will provide for a longer, heavier gauge fuse wire to be wound on a core with a narrower than usual pitch and provide more heat absorbing mass to increase the time delay available from such a spiral wound fuse. Previously, arcing was avoided by using a wider pitch that required a shorter thinner gauge fuse wire for a given current rating.

Additionally, it could be advantageous if spiral wound fuses, which previously could only be used for slow blow applications, could also be used for fast blow applications.

SUMMARY OF THE INVENTION

The invention achieves improved arc quenching in a spiral wound fuse assembly by sandwiching and compressing a fuse wire spirally wound on a support core between the insulating material of the support core and an outer body or layer of substantially flexible insulating material. The outer insulating body can be advantageously held compressed around the fuse wire by a collapsed insulating sleeve or preferably by a an outer wire spirally wrapped therearound. This outer wire can share load current with the inner wire, or it can carry little current and serve mainly to bind the fuse wire assembly together. Alternatively, the outer body can be maintained or retained engaged against the fuse wire by twisting the core assembly or outer body one around the other.

Upon an arc burning away a portion of the fuse wire material, the insulating material of the core and the outer insulating body moves or expands into the space where the arc burned away the fuse wire and where the arc can otherwise subsist. This will block and quench the arc shortly after it strikes and properly interrupt the over current condition occurring through the fuse preventing the arc from traveling to the end cap terminals. The improved arc quenching results in spiral wound fuses that can carry higher currents, typically 5 to 30 amperes of rated current.

Additional achievements of the improved arc quenching include increased time delay in a slow blow fuse. A spiral wound fuse assembly of the invention can use longer, heavier fuse wire wound at a smaller pitch to obtain the same resistance as the shorter, thinner fuse wire previously required to be wound at a larger pitch to avoid arcing between the windings. The heavier fuse wire presents more mass that can absorb more heat before blowing. The insulating body also presents additional mass that can absorb heat from the fuse wire before it blows.

The invention thus results in a shorter fuse for the same current rating because the arc quenching capability of a fuse relates generally to its length. A fuse of the invention, however, will have a higher safe current interrupting ability compared with another fuse of the same length.

In one embodiment, a spiral wound core assembly is contructed and arranged by spirally winding an inner fuse wire or filament on an elongated cylindrical core of flexible insulating material that is an initially limp and substantially dead yarn. This yarn is made by the process disclosed and claimed in U.S. Pat. No. 4,409,729, assigned to the assignee of the present application, which produces twisted together strands of insulating filaments substantially devoid of filament sizing or binding material that could form a conductive path under fuse blowing conditions. Basically, this yarn is made of twisted together strands of NEXTEL ceramic fibers that are baked to eliminate the sizing or binding material that could form the conductive paths under fuse blowing conditions. If desired, other core materials could be used. One or more fuse wires are then spirally wound or placed about this core as, for example, shown in U.S. Pat. No. 4,560,971.

The resulting core assembly then engages with an elongated body of the described flexible insulating material preferably to sandwich the inner fuse wire between the core and the elongated insulating body. The body engages against the spirally wound inner fuse wire at plural locations along the length of the fuse wire assembly. Lastly, an outer wire is spirally wound around the outer elongated insulating body to compress the elongated insulating body against the inner fuse wire or wires.

When an arc strikes and burns away a portion of the inner fuse wire, the flexible material of the elongated body and the core can expand or move into the space where the arc is burning away the fuse wire to block and quench the arc.

In other preferred embodiments, there are two elongated insulating bodies of the flexible insulating material arranged on opposite sides of the core assembly to effect arc quenching.

The invention supplies a spirally wound fast blow fuse by selecting a high resistance outer wire, which would not carry load current, as the insulating body retention means and using a fast acting inner fuse wire of low resistance gauge. The inner fuse wire then can quickly blow under desired over-current conditions.

Alternatively, the outer body takes the form of a sleeve of insulating material encasing the core assembly. This sleeve engages against the spirally wound inner fuse wire along its entire length. Lastly, an outer wrapper of shrinkable plastic tubing retains or maintains the sleeve engaged against the core assembly and inner fuse wire.

In another embodiment, the core assembly is spirally wound around an elongated substantially rectilinear outer body of insulating material. In a last disclosed embodiment, the outer body carries an outer wire spirally wound therearound and the outer body and outer wire sub-assembly are spirally wound around a rectilinear core assembly.

DESCRIPTION OF THE PREFERRED EMBODIMENT

Figures 1, 2A, 2B, 3, 4, 5, 6:
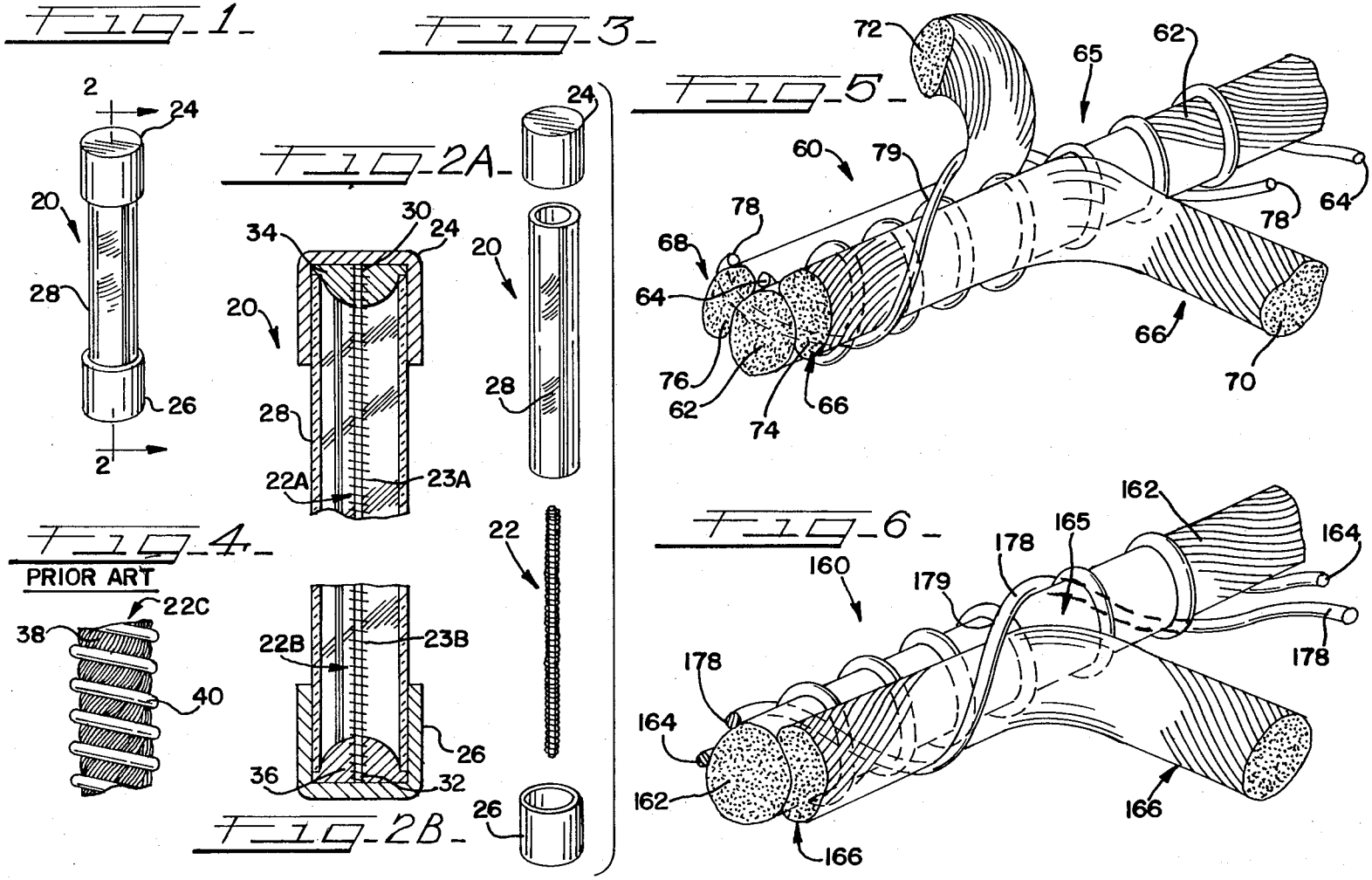
FIG. 4 PRIOR ART
FIG. 1 is a perspective view of a fuse assembly having a spiral wound fuse wire assembly.
FIGS. 2A and 2B are median longitudinal sectional views of the fuse assembly respectively for a slow blow and a fast blow design taken along the lines 2—2 of FIG. 1.
FIG. 3 is an exploded perspective view of the fuse assembly.
FIG. 4 is an elevation view of a portion of the spiral wound fuse wire assembly of the prior fuse assembly.
FIG. 5 is a perspective view of one embodiment of a spiral wound fuse wire assembly of the invention for a slow blow fuse.
FIG. 6 is a perspective view of a second embodiment of a spiral wound fuse wire assembly of the invention for a slow blow fuse.

Referring to FIGS. 1–4, fuse assembly 20 of the invention comprises a spiral wound core assembly 22 suspended between and connected to the end cap terminals 24 and 26 of a cylindrical insulating housing 28. In FIG. 2A, fuse assembly 20 provides a slow blow design in which the spiral wound core assembly 22A includes an outer wire 23A that extends to the end 30 thereof with the end 30 of assembly 22A being connected to end cap terminal 24 by an encasing drop of solder 34. In FIG. 2B, fuse assembly 20 provides a fast blow design in which the spiral wound core assembly 22B includes an outer wire 23B that extends to the end 32 of assembly 22B with the end 32 of assembly 22B being connected to end cap terminal 26 by an encasing drop of solder 36.

In FIG. 2A, the slow blow design furnishes current sharing or dividing between the inner and outer wires based upon the relative resistances of the wires and serves to bind together the assembly. It is preferred that the outer wire 23A be connected to solder drop 34 to insure proper electrical connection and desired current sharing. This reduces the chance of a poor electrical connection to the outer wire and a hot spot in the outer wire acting as a fast blow portion.

In FIG. 2B, the fast blow design furnishes little or no current sharing or dividing between the inner and outer wires based upon the relative resistances of the wires. Typically, the outer wire 23B has more than ten times the resistance of inner wire 22B and carries insignificant current and serves mainly to bind together the assembly. While the inner wire 22B is not necessarily connected to end cap terminal 26 by an encasing drop of solder 36, such connection is desirable for consistency of connection of the core assembly.

In FIG. 4, the previously known spiral wound core assembly 22 comprises a core 38 of a yarn made by the process disclosed and claimed in U.S. Pat. No. 4,409,729 assigned to the assignee of the present application. This yarn is a flexible insulating material that is an initially limp and substantially dead yarn. It is made of twisted together strands of insulating ceramic filaments substantially devoid of filament binding material that could form a conductive path under fuse blowing conditions.

This yarn is made of twisted together strands of NEXTEL ceramic fibers that are baked to eliminate the sizing or binding material that could form the conductive paths under fuse blowing conditions. The spiral wound core assembly 22 also includes an inner fuse wire or filament 40 that is spirally wound on the core 38.

In FIG. 5, fuse wire assembly 60 of the invention for a slow blow fuse comprises a support core 62 of flexible insulating material the same as that described for core 38 and a spirally wound fuse wire or filament 64 of tinned copper material. Core 62 and fuse wire 64 thus form a core assembly 65 similar to that previously known. Fuse wire 64 is wound on core 62 with a small pitch or with closely wound windings to increase the fuse wire mass desirable in a slow blow fuse. This increases the heat absorbing mass of the fuse wire assembly. In addition thereto, a pair of elongated insulating bodies 66 and 68, of the same flexible insulating material as used in support core 62, engage against the core assembly along substantially the length thereof and particularly engage against the inner fuse wire 64 at plural locations along the length of the core assembly. This sandwiches the fuse wire 64 between the elongated bodies 66, 68 and the support core 62. Bodies 66 and 68 initially are formed in a right cylidrical solid configuration, as occurs at ends 70, 72 and, when applied to the support core 62 and inner fuse wire 64, flatten somewhat to conform to the geometry thereof, such as at ends 74 and 76.

The elongated insulating bodies 66 and 68 are preferably retained or maintained against the elongate support core 62 and spirally wound inner fuse wires 64 by an outer fuse or other filament wire 78 spirally wound therearound.

Outer wire 78 is shown with a larger pitch than inner fuse wire 64. This results in insulating bodies 70 and 72 being compressed against the inner fuse wire at multiple locations along the fuse wire assembly 60 and outer wire 78 engaging against fuse wire 64 at multiple locations such as 79. Other pitches of the inner and outer fuse wires can be selected as desired and obtain these multiple engagement or sandwich locations.

Outer wire 78 substantially compresses the inner fuse wire or filament 64 between the support core 62 and the elongated insulating bodies 66 and 68 so that an arc burning away a portion of the inner fuse wire between blown ends thereof can be quenched by the core and body insulating materials expanding or moving into the space where the arc is burning away the portion of the inner fuse wire. The insulating material of the core and elongate bodies then will block and quench the arc shortly after its formation to interrupt the flow of current through the fuse wire assembly 60.

The fuse wire assembly 60 is intended to act as a slow blow fuse so that either the inner or the outer wire can carry most of the load current. The outer fuse wire 78 maintains the elongated bodies of insulation 66 and 68 in close contact or engagement against the inner fuse wire 64 substantially across the entire length of the inner fuse wire to quench any arcs occurring therein. Arcs occurring in outer wire 78 can be quenched by insulators 66 and 68 and core 62 blocking an arc attempting to extend around the outside of assembly 60.

It will be understood that the fuse wire assemblies of this embodiment and the following embodiments are illustrated in a somewhat idealized geometric configuration simply to illustrate the structure. Further, the completely assembled fuse wire assemblies of this and the following embodiments are shown at only one end thereof with the elements of the fuse wire assemblies being shown in an unassembled state at the other end thereof better to show structural detail. While the fuse wire assemblies of this and the following views are shown to have a definite length substantially to be suspended and connected between the end cap terminals of a fuse assembly, it will be understood that such fuse wire assemblies can have substantially increased length.

In the following embodiments, like structure will be identified by reference numerals having like ones and tens units numerals.

In FIG. 6, fuse wire assembly 160 for a slow blow fuse comprises an elongated core 162 of insulating material and an inner fuse wire 164 together forming a spirally wound core assembly 165. Fuse wire assembly 160 further includes an elongated insulating body 166 of the same, flexible insulating material engaged against the core assembly 165 along substantially the length thereof in the manner and for the purposes described in connection with the fuse wire assembly 60 of FIG. 5. An outer fuse wire 178 is spirally wound around the core assembly 165 and insulating body 166 to maintain the elongated body 166 of insulating material engaged against the elongated core assembly 165 and to compress the inner fuse wire 164 between the core and body insulating material. This obtains the arc quenching characteristics described in connection with the fuse wire assembly 60 of FIG. 5, but in a different configuration with only one extra insulator 166.

Fuse wire assembly 160 is constructed and arranged for a slow blow application in which the inner and outer wires or filaments 164 and 178 both carry appreciable current. In this configuration, the inner fuse wire 164 is wound at a small pitch, and outer wire 178 is wound at a large pitch. This compresses a portion of each turn of inner fuse wire 164 between the core 162 and the insulating material of elongated body 166. Across the remainder of each turn of inner fuse wire 164, the inner and outer fuse wires 164 and 178 are in direct contact with one another at the locations at which they cross, such as at location 179.

Figure 7:
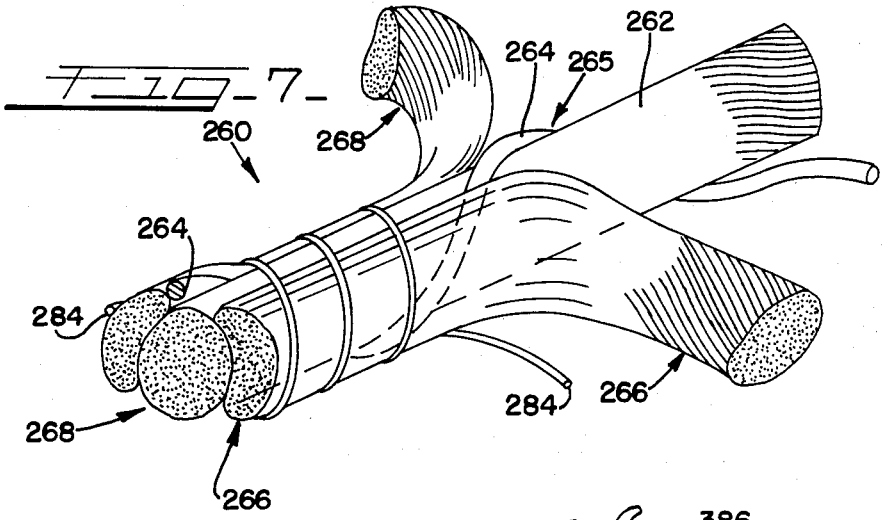
FIG. 7 is a perspective view of a third embodiment of a spiral wound fuse wire assembly of the invention for a fast blow fuse.

In FIG. 7, fuse wire assembly 260 for a fast blow fuse comprises a support core 262 of flexible insulating material and an inner fuse wire 264 spirally wound thereabout to form a spirally wound core assembly 265. Fuse wire 264 is wound at a large pitch to reduce the heat absorbing mass of the fuse wire assembly and obtain better fast blow characteristics. Similar to fuse wire assembly 60, two elongate bodies 266 and 268 of the flexible insulating material are engaged against the core assembly 265 substantially along the length thereof. The elongated bodies 266 and 268 are maintained in engaged relationship against the core assembly 265 by an outer wire 284 that has a high resistance and that is wound at a small or narrow pitch. Outer wire 284 typically has ten times the resistance of inner wire 264 and carries little load current therethrough. Its main function is to bind together the fuse wire assembly.

Fuse wire assembly 260 is designed to be used in fast blow fuse applications where spirally wound fuses previously had not been able to be used. Again, all of the arc-quenching achievements and functions previously described in connection with fuse wire assembly 60 are achieved or attained by the fuse wire assembly 260.

Figure 8:
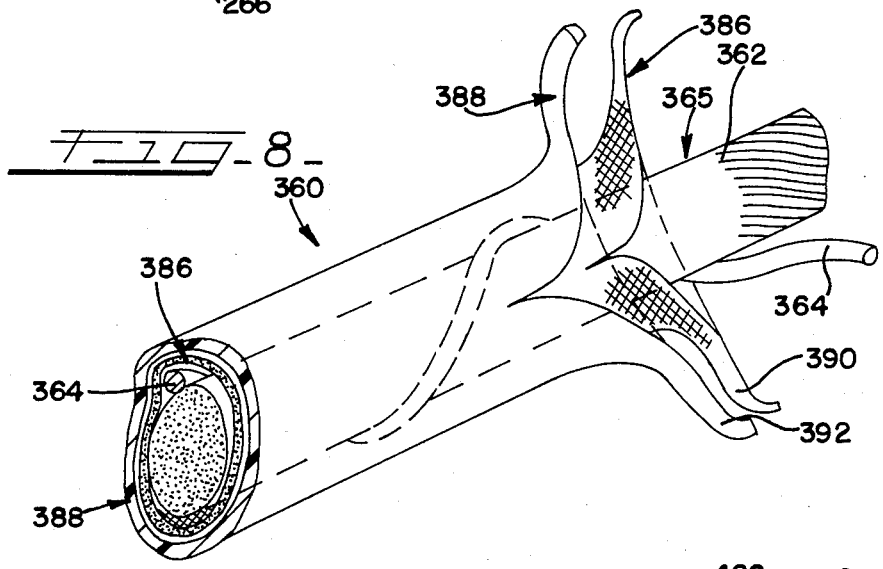
FIG. 8 is a respective view of a fourth embodiment of a spiral wound fuse wire assembly of the invention for a slow blow fuse.

In FIG. 8, a fuse wire assembly 360 comprises a support core 362 and an inner fuse wire 364 spirally wound therearound to form a spirally wound core assembly 365. A sleeve 386 of the described flexible insulating material woven into a cylindrical body is placed around the core assembly 365. An outer wrapper 388 of such as a tube of thermalplastic shrink material is placed thereareound and is shrunk by application of heat to engage the sleeve 386 of insulating material tightly against the core assembly 365 and inner fuse wire 364. The end 390 the sleeve 386 and the end 392 of the outer wrapper 398 are cut open for easy viewing of the core assembly 365.

Fuse wire assembly 360 achieves all of the previously described arc quenching functions of the invention at substantially continuous locations along the entire length of the inner fuse wire 364.

Figure 9:
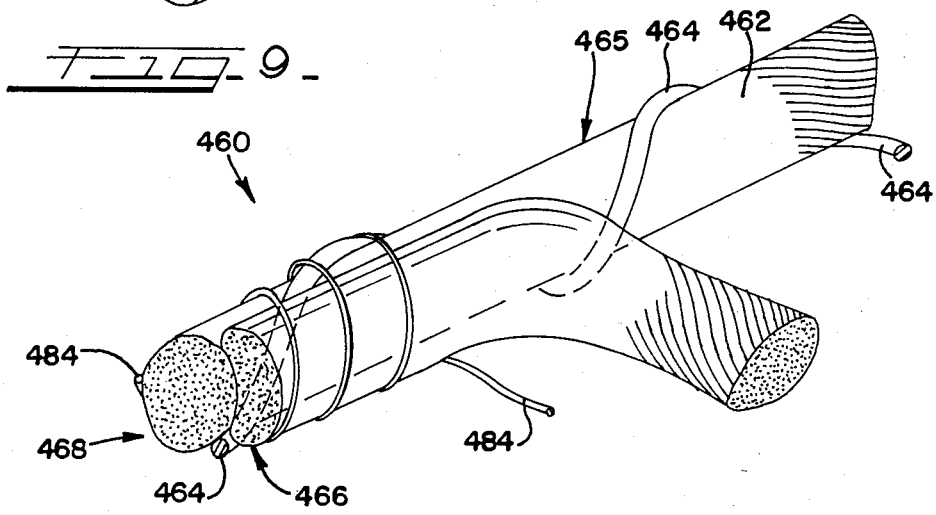
FIG. 9 is a perspective view of a fifth embodiment of a spiral wound fuse wire assembly of the invention for a fast blow fuse.

In FIG. 9, fuse wire assembly 460 for a fast blow fuse comprises a support core 462 of the described insulating material and an inner fuse wire 464 spirally wound therearound at a large pitch to form a spirally wound core assembly 465. An elongated body 466 of the described flexible insulating material engages against the length of the core assembly 465, and an outer fuse wire 484, spirally wound thereabout at a narrow pitch, maintains the insulating material of the elongated body 466 closely engaged against the inner fuse wire 464 and support core 462.

This embodiment achieves the arc-quenching functions previously described in a fast blow fuse wire assembly having a single outer elongated body of insulating material.

Figure 11:
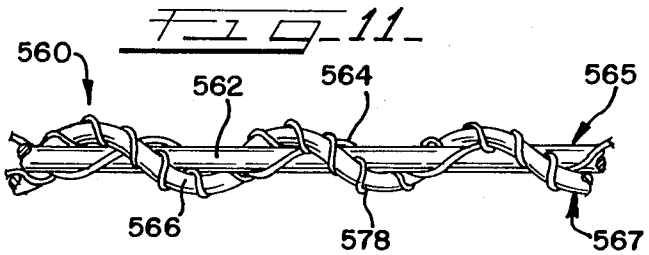
FIG. 11 is an idealized side elevational view of the first pair of insulators and spiral wound fuse wires of the sixth embodiment of a spiral wound fuse wire assembly of the invention for a slow blow fuse.
Figure 10:
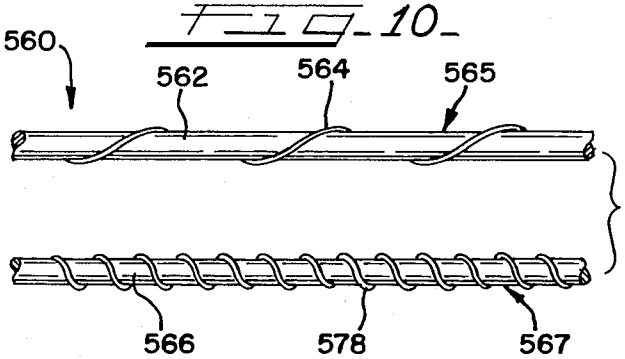
FIG. 10 is an idealized side elevational view of a first pair of insulators and spiral wound fuse wires of a sixth embodiment of a spiral wound fuse wire assembly of the invention for a slow blow fuse.

In FIGS. 10 and 11, fuse wire assembly 560 for a slow blow fuse comprises a support core 562 of the described insulating material and an inner fuse wire 564 spirally wound therearound at a large pitch to form a spirally wound core assembly 565. An elongated body 566 of the described flexible insulating material carries an outer wire 578 spirally wound therearound at a narrow pitch to form a spirally wound outer insulator assembly 567. Wires 564 and 578 are selected substantially to share the load current therebetween.

In FIG. 11, the outer insulator assembly 567 is spirally wound around core assembly 565 to obtain the completed fuse wire assembly 560 for a slow blow fuse. This obtains the arc-quencing achievements of the invention in an embodiment where the outer wire 578 is wound around the extra or outer body 566 of insulating material instead of around the entire fuse wire assembly. While FIG. 11 ideally shows the core assembly 565 remaining rectilinear while the outer assembly 567 is spirally wound therearound, alternatively the resulting fuse wire assembly can resemble two sub-assemblies twisted around one another. This twisting and spiral winding of insulators and wires forms mulitple engagements, in this embodiment and the other embodiments, between the insulating materials and wires to quench any arcs near to where they may begin and prevent any such arcs from extending between the end terminal caps of the fuse assembly in which it may be mounted.

Figure 13:
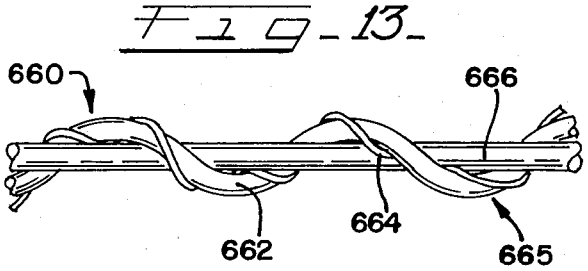
FIG. 13 is an idealized side elevational view of the second pair of insulators and spiral wound fuse wire of the seventh embodiment of a spiral wound fuse wire assembly of the invention for a slow blow fuse.
Figure 12:
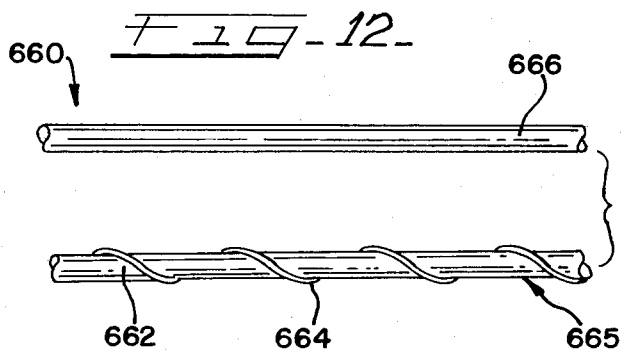
FIG. 12 is an idealized side elevational view of a second pair of insulators and spiral wound fuse wire of a seventh embodiment of a spiral wound fuse wire assembly of the invention for a slow blow fuse.

In FIGS. 12 and 13, fuse wire assembly 660 for a slow blow fuse comprises a support core 662 of the described insulating material and an inner fuse wire 664 spirally wound therearound at a desired pitch to form a spirally wound core assembly 665. An elongated body 666 of the described insulating material exists alongside core assembly 665 and carries no wire.

In FIG. 13, the core assembly 665 is spirally wound around body 666 of insulating material to obtain the completed fuse wire assembly 660 for a slow blow fuse. This embodiment also obtains the arc-quenching acheivements of the invention where the core assembly 665 is wound around another body 666 of insulating material with no outer wire binding together the assembly. While FIG. 13 ideally shows the core assembly 665 being spirally wound around the insulator body 666, alternatively the resulting fuse wire assembly can resemble two sub-assemblies twisted around one another. This twisting of insulators and fuse wire of this embodiment and of the previously described embodiments forms the desired multiple engagements therebetween to quench any arcs near to where they may begin, in this embodiment, with only the one fuse wire and without an outer binding wire.

In the embodiments of FIGS. 10, 11, 12 and 13, the fuse wire assemblies retain their configurations through the tendency of the twisted together fibers of the insulating materials to retain their elongate yarn shape, while being flexible, and more importantly, it is believed, through the rigidity of the wire or wires to retain their configuration around and between the insulating materials.

The exemplary parameters for a fuse wire assembly to be used in a fast blow configuration are:

core diameter 0.017", length 1.2"; inner fuse wire gauge 0.0055 diameter silver wire, pitch 0.074";
insulating body diameter 0.025", length 1.2"; outer wire gauge 0.00165" diameter Tophet A wire, pitch 0.046".

Fuse rating: 43 amperes

Typical blow times: 5.8 amperes (1.35×In), 30 seconds; 8.6 amperes (2×In), 1.3 seconds; 21.5 amperes (5×In), 0.007 seconds.

The exemplary dimensions for a fuse wire assembly to be used in a slow blow configuration are:

core diameter 0.017", length 1.2"; inner fuse wire gauge 0.0132" diameter tin-plated copper wire, pitch 0.073";
insulating body diameter 0.025", length 1.2"; outer wire gauge 0.0122" diameter tin-flashed copper wire, pitch 0.032".

Fuse rating: 11 amperes

Typical blow times: 14.9 amperes (1.35×In), 20 minutes; 22 amperes (2×In), 11 seconds; 55 amperes (5×In), 0.8 second.

Modifications and variations of the present invention are possible in light of the above teachings. For example, the relative thicknesses of the support core, elongated bodies of insulating materials, and the inner and outer fuse wires can be selected as desired to obtain a fast blow or slow blow fuse wire assembly having desired current-carrying and fuse-blowing capabilities. Other insulating materials can be used that flex sufficiently to move into the space at which an arc is burning away the ends of the blown fuse wire to block and quench the same. Other embodiments with desired pitches in the windings of fuse wires and insulators can be selected while obtaining the arc-quenching features of the invention, and the direction of the windings or twistings can be as desired.

Different numbers of core and elongated bodies of insulating material can be used as desired, and the elongated body of insulating material can be spirally wound around the core and inner fuse wire core assembly instead of being rectilinearly applied thereto, although the rectilinear arrangement uses the least amount of insulating material.

I claim:

1. A fuse wire assembly for suspension between and connection to a pair of spaced end cap terminals of an insulating cylindrical housing, said fuse wire assembly comprising:

A. an elongated core assembly including an elongate core of insulating material and an inner fuse wire spirally wound on the core at a first pitch; and B. at least one body of flexible insulating material retained against said core assembly to engage against said inner fuse wire at plural locations along the length of said core assembly and sandwich said inner fuse wire between said core and body at said plural locations, so that an arc burning away a portion of said inner fuse wire between blown ends of said first fuse wire can be quenched by at least said insulating material of said body moving into the space where said arc burned away-said portion of said first fuse wire and said arc subsists.

2. The fuse wire assembly of claim 1 in which the insulating material of at least the elongated body includes an initially limp and substantially dead yarn made of twisted together strands of insulating filaments substantially devoid of filament binding material capable of forming a conductive path under fuse blowing conditions.

3. The fuse wire assembly of claim 2 in which said core and elongated body include the same insulating material.

4. The fuse wire assembly of claim 1 in which said insulating material of said core and body is flexible and capable of expanding into said space.

5. The fuse wire assembly of claim 1 in which there are plural bodies of insulating material engaging against said core assembly.

6. The fuse wire assembly of claim 5 in which there are two rectilinear bodies of insulating material, said core assembly is rectilinear and said two bodies engage along the sides of said core assembly.

7. The fuse wire assembly of claim 1 in which there is one body of insulating material engaging against said core assembly.

8. The fuse wire assembly of claim 7 in which said one body is a sleeve of insulating material encasing said core assembly.

9. The fuse wire assembly of claim 7 in which said one body is rectilinear, said core assembly is rectilinear and said one body engages alongside said core assembly.

10. The fuse wire assembly of claim 7 in which said core assembly is rectilinear and said one body of insulating material is spirally wound around said core assembly.

11. The fuse wire assembly of claim 7 in which said one body of insulating material is rectilinear and said core assembly is spirally wound around said one body.

12. The fuse wire assembly of claim 1 including retainer means for retaining said body of insulating material engaged against said elongate core assembly and sandwiching and compressing said inner fuse wire between said core assembly and body of insulating material.

13. The fuse wire assembly of claim 12 in which said core assembly and at least one body of insulating material are rectilinear and are arranged alongside one another, and said retainer means include an outer wire spirally wound around said core assembly and at least one body of insulating material.

14. The fuse wire assembly of claim 12 in which said core assembly is rectilinear, said at least one body is a sleeve encasing said core assembly and said retainer means include an outer wrapper of shrinkable tubing around the outside of said sleeve.

15. The fuse wire assembly of claim 1 in which one of said core assembly and body are spirally wound around the other to retain said body engaged against said core assembly.

16. The fuse wire assembly of claim 15 in which said body of insulating material is rectilinear and said core assembly is spirally wound around said body.

17. The fuse wire assembly of claim 15 in which said body carries an outer wire spirally wound therearound, and said body and outer wire are spirally wound around said core assembly.

18. The fuse wire assembly of claims 13 or 17 in which said outer wire is wound at a second pitch different from said first pitch.

19. The fuse wire assembly of claims 13 or 17 in which said inner and outer wires have resistances selected to share load current therebetween to form a slow blow fuse.

20. The fuse wire assembly of claims 13 or 17 in which said inner and outer wires have resistances selected for the inner wire to carry most of the load current to form a fast blow fuse.

21. The fuse wire assembly of claim 1 mounted in a fuse housing with a pair of spaced terminals at the ends of said housing and said fuse wire assembly being suspended between the ends of said housing, said inner fuse wire being electrically connected to said terminals.

22. A fuse wire assembly for suspension between and connection to a pair of spaced end cap terminals of an insulating cylindrical housing, said fuse wire assembly comprising:

A. an elongated core assembly including an elongated substantially cylindrical core of flexible insulating material formed of an initially limp and substantially dead yarn made of twisted together strands of insulating filaments substantially devoid of filament binding material capable of forming a conductive path under fuse blowing conditions, and a inner fuse wire spirally wound therearound a number of times at a first pitch;

B. an elongated body of said insulating material extending substantially rectilinearly along and engaged against substantially the length of said core assembly particularly to engage against said inner fuse wire at plural locations along said core assembly to sandwich and compress said inner fuse wire between said core and body of insulating materials; and C. an outer fuse wire spirally wound around said core assembly and said elongated body a number of times at a second pitch to maintain said elongated body against said core assembly and compress said inner fuse wire between said core and body so that an arc burning away a portion of said inner fuse wire between blown ends thereof can be quenched by the core and body insulating material moving into the space where said arc burned away said portion of said inner fuse wire and where said arc subsists.

23. The fuse wire assembly of claim 22 in which said first pitch is smaller than said second pitch.

24. The fuse wire assembly of claim 22 in which said first pitch is larger than said second pitch.

25. The fuse wire assembly of claim 22 in which said inner and outer wires have resistances selected for the inner and outer wires to share load current therebetween to form a slow blow fuse.

26. The fuse wire assembly of claim 22 in which said inner and outer wires have resistances selected for one of said wires to carry most of the load current to form a fast blow fuse.

27. The fuse wire assembly of claim 22 in which there are two such elongated bodies similarly arranged with the outer fuse wire spirally wound around said core assembly and said two elongated bodies.

28. A fuse wire assembly for suspension between and connection to a pair of spaced end cap terminals of an insulating cylindrical housing, said fuse wire assembly comprising:

A. an elongated core assembly including an elongated substantially cylindrical core of flexible insulating material formed of an initially limp and substantially dead yarn made of twisted together stands of insulating filaments substantially devoid of filament binding material capable of forming a conductive path under fuse blowing conditions, and an inner fuse wire spirally wound therearound a number of times at a first pitch;

B. an elongated body of said insulating material engaged against substantially the length of said core assembly particularly to engage against said inner fuse wire at plural locations along said core assembly where said inner fuse wire is sandwiched between said core and body of insulating materials; and C. one of said core assembly and said elongated body being spirally wound around the other to compress said inner fuse wire between said core and body so that an arc burning away a portion of said inner fuse wire between blown ends thereof can be quenched by the core and body insulating material moving into the space where said arc burned away said portion of said inner fuse wire and where said arc subsists.

29. The fuse wire assembly of claim 28 in which said elongated body extends substantially rectilinearly and said core assembly is spirally wound around said elongated body.

30. The fuse wire assembly of claim 28 in which said elongated body carries an outer wire spirally wound therearound and said elongated body and outer wire are spirally wound around said core assembly.

* * * * *